US007876227B2

(12) United States Patent
Bellows

(10) Patent No.: US 7,876,227 B2
(45) Date of Patent: Jan. 25, 2011

(54) POLARIZATION INSENSITIVE ANTENNA FOR HANDHELD RADIO FREQUENCY IDENTIFICATION READERS

(75) Inventor: David Bellows, Wantagh, NY (US)

(73) Assignee: Symbol Technologies, Inc., Holtsville, NY (US)

( * ) Notice: Subject to any disclaimer, the term of this patent is extended or adjusted under 35 U.S.C. 154(b) by 331 days.

(21) Appl. No.: 12/129,363

(22) Filed: May 29, 2008

(65) Prior Publication Data

US 2009/0295567 A1 Dec. 3, 2009

(51) Int. Cl.
*G08B 13/14* (2006.01)

(52) U.S. Cl. ..... 340/572.7; 340/572.4; 340/10.42; 340/539.11

(58) Field of Classification Search ... 340/572.1–572.8, 340/539.11, 10.42; 343/728, 746, 748, 767, 343/866

See application file for complete search history.

(56) References Cited

U.S. PATENT DOCUMENTS

| | | | | |
|---|---|---|---|---|
| 7,298,251 | B2 * | 11/2007 | Meyers et al. | 340/505 |
| 7,427,955 | B2 * | 9/2008 | Choi et al. | 343/700 MS |
| 2008/0129641 | A1 * | 6/2008 | Lee et al. | 343/876 |
| 2008/0174432 | A1 * | 7/2008 | Ulrich | 340/572.1 |

* cited by examiner

*Primary Examiner*—Anh V La

(57) ABSTRACT

A handheld radio frequency identification (RFID) reader includes a polarization insensitive antenna that enables simultaneous operation in two orthogonal polarization modes. The RFID reader includes an RF communication module and an antenna coupled to the RF communication module. The RF communication module is configured to process RF signals associated with operation of the RFID reader, and the antenna is configured to transmit and receive RF energy associated with operation of the RFID reader. The antenna includes a conductive loop element having a major longitudinal path, and a slot formed in the conductive loop element along the major longitudinal path. The conductive loop element is configured to operate as a first antenna polarized in a first orientation, and the slot is configured to operate as a second antenna polarized in a second orientation.

20 Claims, 6 Drawing Sheets

POLARIZATION INSENSITIVE ANTENNA FOR HANDHELD RADIO FREQUENCY IDENTIFICATION READERS

TECHNICAL FIELD

Embodiments of the subject matter described herein relate generally to radio frequency (RF) antennas. More particularly, embodiments of the subject matter relate to an RF antenna suitable for use with an RF identification (RFID) reader.

BACKGROUND

RFID systems are well known and the prior art includes different types of RFID systems, different applications for RFID systems, and different data communication protocols for RFID systems. RFID systems are commonly utilized for product tracking, product identification, and inventory control in manufacturing, warehouse, and retail environments. Briefly, an RFID system includes two primary components: a reader (also known as an interrogator); and a tag (also known as a transponder). The tag is a miniature device that is capable of responding, via an air channel, to an RF signal generated by the reader. The tag is configured to generate a reflected RF signal in response to the RF signal emitted from the reader. The reflected RF signal is modulated in a manner that conveys identification data back to the reader. The identification data can then be stored, processed, displayed, or transmitted by the reader as needed.

Due to the size and complexity of the necessary components, fixed RFID readers mounted by doorways, loading docks, and assembly lines were the first to be developed and deployed in the field. As RFID technology matures and continues to emerge as a force in the data acquisition industry, the need for mobile handheld RFID readers becomes increasingly important. Handheld RFID readers have traditionally leveraged the RF antenna designs from fixed reader equipment. In this regard, some RFID reader antennas are relatively large, heavy, and obtrusive, and other RFID antennas provide either horizontal polarization or vertical polarization. Conventional RFID tags are typically polarized in only one direction: vertical or horizontal. Therefore, a horizontally polarized RFID reader antenna is unable to accurately read a vertically polarized tag without physical manipulation or rotation of the reader and/or tag. Likewise, a vertically polarized RFID reader antenna is unable to accurately read a horizontally polarized tag without physical manipulation or rotation of the reader and/or tag.

In practice, handheld RFID-enabled products have traditionally needed to make significant design compromises, such as antenna size and performance versus product size, polarization diversity versus product size and ergonomics, and the like. There remains a need for a compact and polarization insensitive antenna design that is suitable for handheld RFID readers.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, brief summary or the following detailed description.

The subject matter may be described herein in terms of functional and/or logical block components and various processing steps. It should be appreciated that such block components may be realized by any number of hardware, software, and/or firmware components configured to perform the specified functions. For example, an embodiment may employ various integrated circuit components, e.g., memory elements, digital signal processing elements, logic elements, look-up tables, or the like, which may carry out a variety of functions under the control of one or more microprocessors or other control devices.

The following description refers to elements or nodes or features being "connected" or "coupled" together. As used herein, unless expressly stated otherwise, "connected" means that one element/node/feature is directly joined to (or directly communicates with) another element/node/feature, and not necessarily mechanically. Likewise, unless expressly stated otherwise, "coupled" means that one element/node/feature is directly or indirectly joined to (or directly or indirectly communicates with) another element/node/feature, and not necessarily mechanically. Thus, although the schematic shown in FIG. 3 depicts one exemplary arrangement of elements, additional intervening elements, devices, features, or components may be present in an embodiment of the depicted subject matter.

An RFID reader as described herein utilizes a polarization insensitive multi-operational antenna that is relatively small in size, achieves good RF performance, and is insensitive to the polarization of the RFID tags being interrogated by the RFID reader. The antenna design can be implemented to accommodate the packaging requirements and configuration of existing RFID reader equipment and/or to accommodate new equipment. For the sake of brevity, conventional techniques related to RFID data transmission, RFID system architectures, RF antenna design, signal processing, and other functional aspects of the systems (and the individual operating components of the systems) may not be described in detail herein.

Figure 1A:
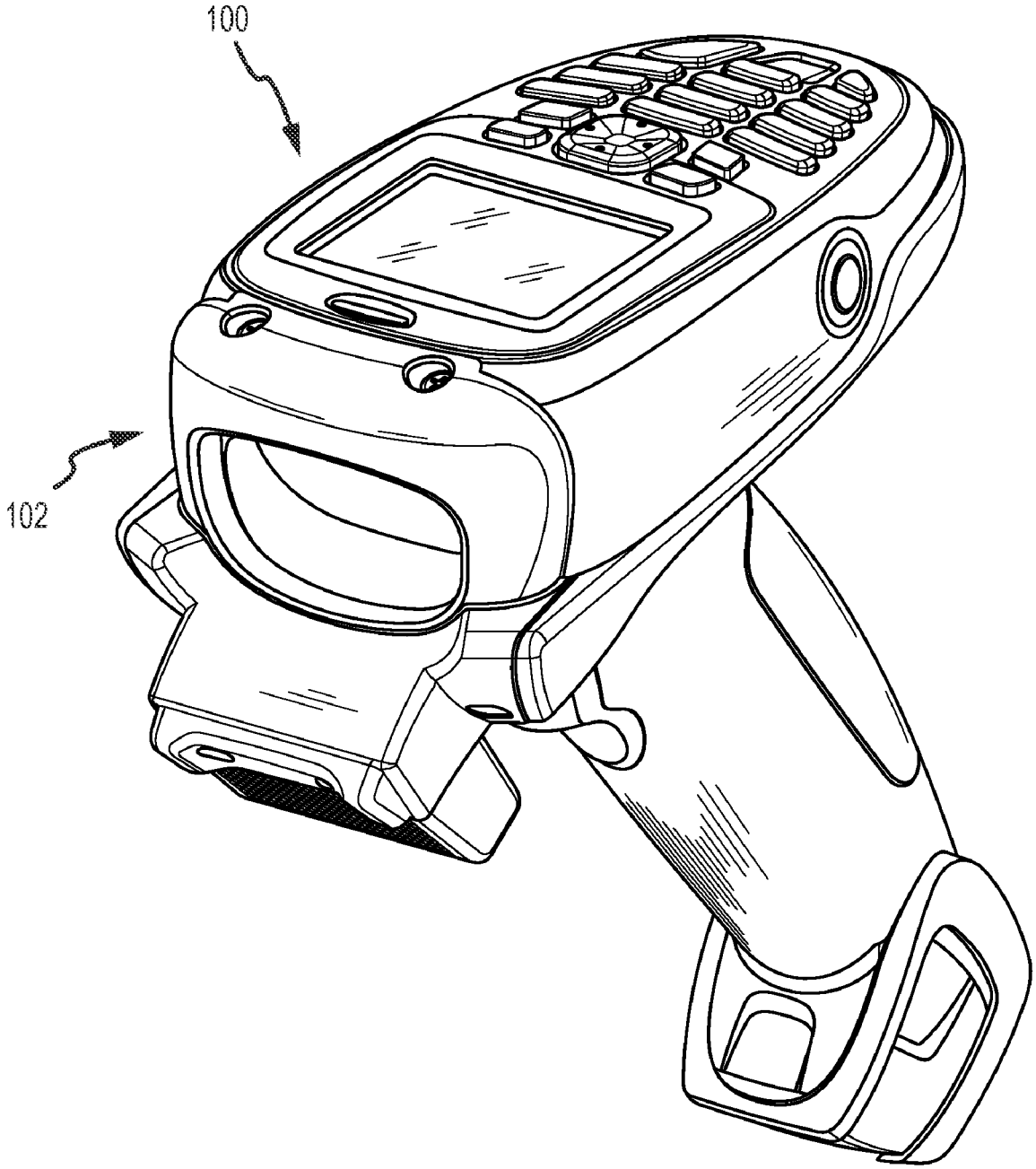
FIG. 1A is a perspective view of a first embodiment of an RFID reader that incorporates a polarization insensitive antenna.
Figure 1B:
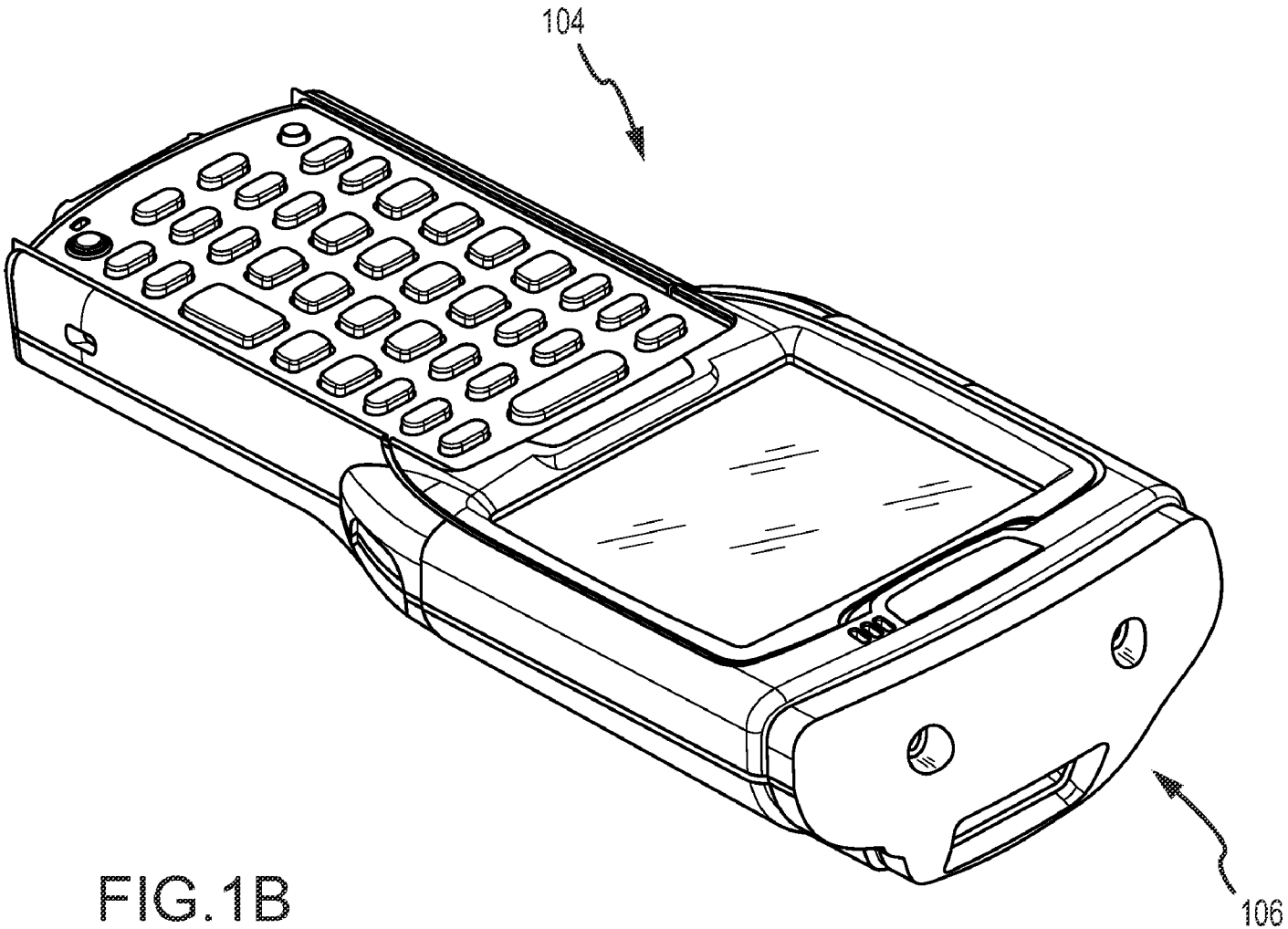
FIG. 1B is a perspective view of a second embodiment of an RFID reader that incorporates a polarization insensitive antenna.
Figure 2:
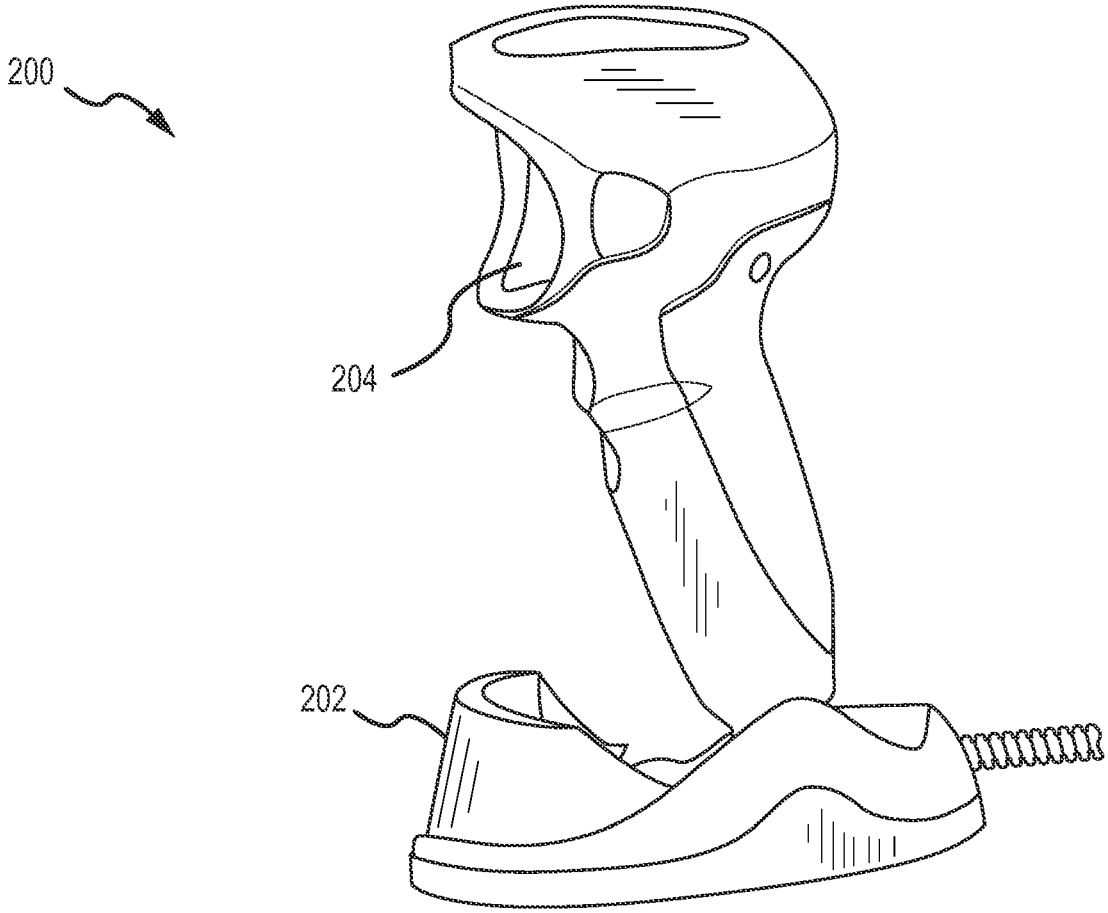
FIG. 2 is a perspective view of a third embodiment of an RFID reader that incorporates a polarization insensitive antenna.

FIG. 1A is a perspective view of a first embodiment of an RFID reader 100 that incorporates a polarization insensitive antenna component 102, FIG. 1B is a perspective view of a second embodiment of an RFID reader 104 that incorporates a polarization insensitive antenna component 106, and FIG. 2 is a perspective view of a third embodiment of an RFID reader 200 that incorporates a polarization insensitive antenna component 202. Referring to FIG. 1A, RFID reader 100 is a relatively small and compact handheld device that can be operated to interrogate RFID tags within its interrogation range. RFID reader 100 utilizes antenna component 102 to transmit RFID interrogation signals, and to receive response signals generated by RFID tags. This particular embodiment of RFID reader 100 is gun-shaped, and it uses a front-mounted antenna component 102 that is naturally pointed toward the intended target during normal handheld operation of RFID reader 100. Referring to FIG. 1B, RFID reader 104 is another relatively small and compact handheld device, which utilizes antenna component 106 to transmit RFID interrogation signals, and to receive response signals generated by RFID tags. This particular embodiment of RFID reader 104 has its antenna component 106 located at the top of the housing, to accommodate pointing toward the intended target during normal handheld operation of RFID reader 104. Referring to FIG. 2, RFID reader 200 represents a hybrid device that includes antenna component 202 for purposes of supporting RFID operations. In addition, RFID reader 200 may include another scanning element 204 that supports non-RFID operations. For example, scanning element 204 may be a wireless bar code scanner. In practice, the polarization insensitive antenna designs described herein can be deployed in any number of RFID reader (or mobile computing device) configurations, and the embodiments depicted in FIG. 1 and FIG. 2 are merely exemplary.

Figure 3:
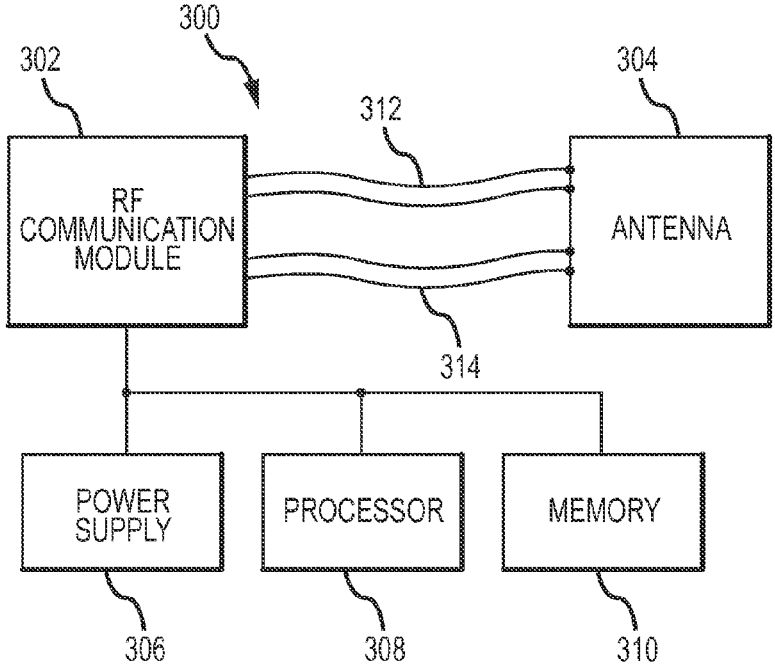
FIG. 3 is a schematic representation of an embodiment of an RFID reader.

FIG. 3 is a schematic representation of an embodiment of an RFID reader 300 that utilizes a polarization insensitive antenna. RFID readers 100, 104, and 200 may incorporate the arrangement depicted in FIG. 3. It should be apparent that FIG. 3 depicts RFID reader 300 in a very simplified manner, and a practical embodiment will of course include many additional features and components. RFID reader 300 generally includes, without limitation: an RF communication module 302; an antenna 304 coupled to RF communication module 302; a power supply 306; a processor 308; and an appropriate amount of memory 310. Although not depicted in FIG. 3, RFID reader 300 may also include a housing, a display element, a keypad, an interrogation trigger, a touch panel, other input/output elements, or the like. The various operating elements of RFID reader are coupled together as needed to facilitate the delivery of operating power from power supply 306, the transfer of data, the transfer of control signals and commands, and the like.

RF communication module 302 is suitably configured to process RF signals associated with the operation of RFID reader 300, and to otherwise support the RFID functions of RFID reader 300. In this regard, RF communication module 302 may include a transceiver or radio element that generates RFID interrogation signals and receives reflected RFID signals generated by RFID tags in response to the interrogation signals. As described in more detail below, RF communication module 302 is suitably configured to generate the RF drive signals for antenna 304. In the exemplary embodiment described herein, RF communication module 302 is designed to operate in the UHF frequency band designated for RFID systems. Alternate embodiments may instead utilize the High Frequency band or the Low Frequency band designated for RFID systems. For example, in the United States, RFID systems may utilize the 902-928 MHz frequency band, and in Europe, RFID systems may utilize the 865-868 MHz frequency band. Notably, antenna 304 can be designed, configured, and tuned to accommodate the particular operating frequency band of the host RFID reader.

Antenna 304 is suitably configured to transmit and receive RF energy associated with the operation of RFID reader 300. Accordingly, antenna 304 can be coupled to RF communication module 302 using two RF transmission lines 312/314. One exemplary antenna configuration is described in detail with reference to FIG. 4. Although not separately shown in FIG. 3, antenna 304 preferably includes a conductive loop element that functions as a loop antenna, and a slot formed in the conductive loop element (the slot functions as a slot antenna). Accordingly, RF transmission line 312 is utilized for the conductive loop element, and RF transmission line 314 is utilized for the slot (or vice versa). In certain embodiments, two-conductor RF coaxial cables can be used for RF transmission lines 312/314, in combination with suitable RF connectors, plugs, nodes, or terminals on RF communication module 302 and/or on antenna 304.

Power supply 306 may be a disposable or rechargeable battery, a set of batteries, or a battery pack that is rated to provide the necessary voltage and energy to support the operation of RFID reader 300. Alternatively or additionally, power supply 306 may receive power from an external source such as an ordinary AC outlet.

Processor 308 may be any general purpose microprocessor, controller, or microcontroller that is suitably configured to control the operation of RFID reader 300. In practice, processor 308 may execute one or more software applications that provide the desired functionality for RFID reader 300. In this regard, processor 308 can control, manage, and regulate operation of RFID reader 300 in different polarization modes, different interrogation modes, and the like, where the different modes utilize the conductive loop and/or the radiating slot of antenna 304.

Memory 310 may be realized as any processor-readable medium, including an electronic circuit, a semiconductor memory device, a ROM, a flash memory, an erasable ROM, a floppy diskette, a CD-ROM, an optical disk, a hard disk, an organic memory element, or the like. For example, memory 310 is capable of storing application software utilized by RFID reader 300 and/or RFID data captured by RFID reader 300 during operation.

As mentioned briefly above, antenna 304 may utilize a loop antenna, which can be designed to achieve a desired polarization. Although the electrical length of an ideal loop antenna should be approximately one wavelength long (between input nodes), an impedance matched balun and inductive base loading can be utilized to shorten the physical length of a loop antenna. A slot antenna can be created by cutting a slot approximately one-half wavelength long in conductive material such as a copper sheet. This type of antenna is essentially the negative of a dipole or loop antenna because it is the absence of conductive material that creates a resonating structure, as opposed to the conductive material itself. The edges of the slot radiate, resulting in reversal of the electric and magnetic fields. Consequently, the polarity of a slot antenna is opposite compared to that of a loop antenna. In other words, a horizontal slot is vertically polarized, and a vertical slot is horizontally polarized.

The technique described here utilizes a half-wavelength slot formed in the conductive material of a loop antenna. Thus, two orthogonal polarizations can be achieved using one antenna structure. The antenna structure described herein resonates the slot at the same frequency as the conductive loop element, orthogonal in polarization. Adding this second antenna element (the slot) does not increase the overall size of the antenna and, as a result, the size impact to the host RFID reader is negligible.

Figure 4:
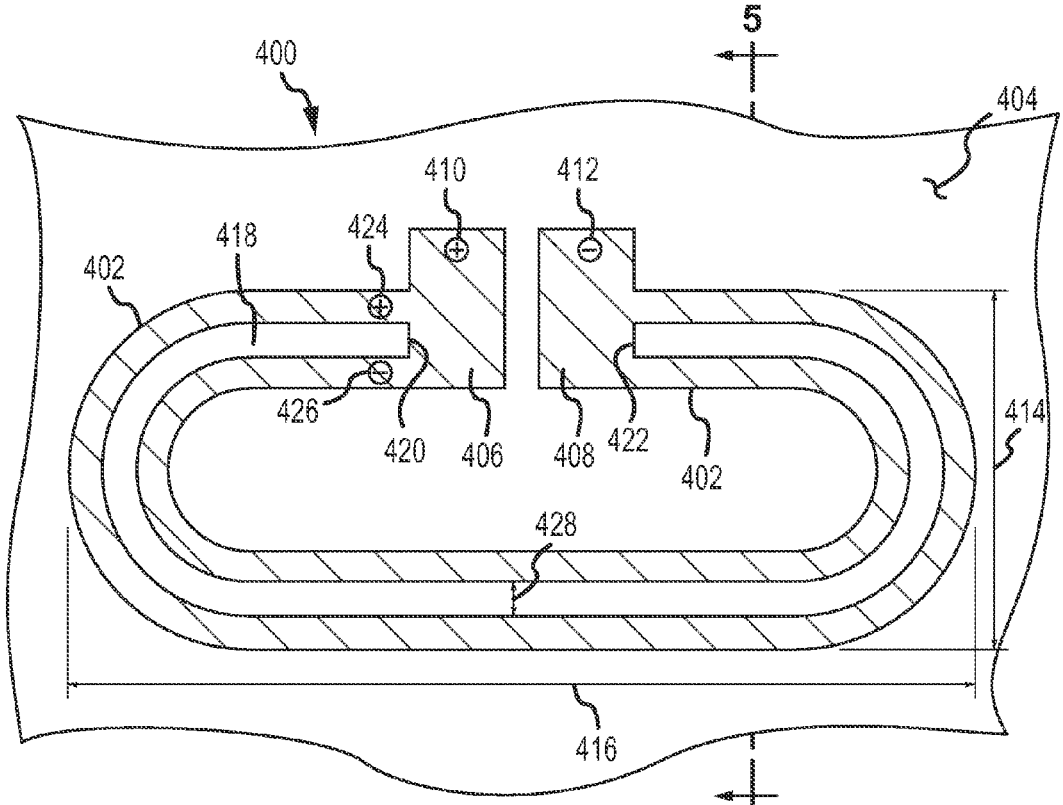
FIG. 4 is a layout diagram of a first embodiment of an RF antenna suitable for use in an RFID reader.
Figure 5:
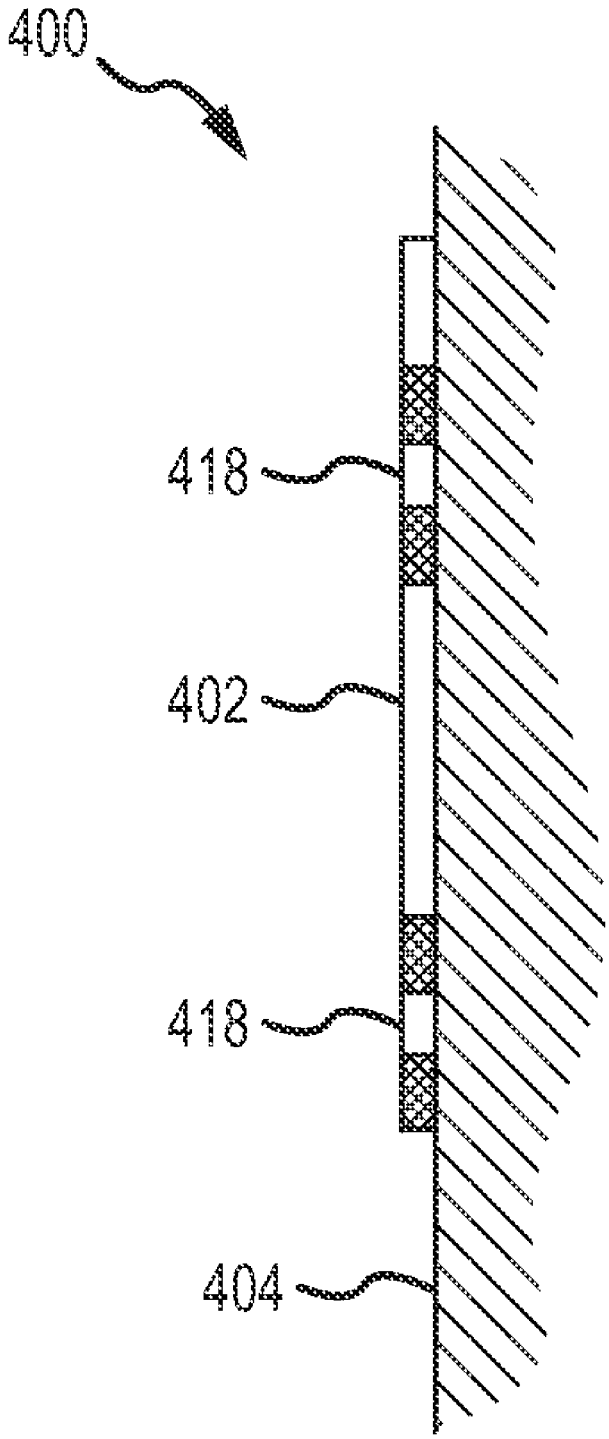
FIG. 5 is a cross sectional view of the RF antenna as viewed from line 5-5 in FIG. 4.

FIG. 4 is a layout diagram of a first embodiment of an RF antenna 400 suitable for use in an RFID reader, and FIG. 5 is a cross sectional view of RF antenna 400 as viewed from line 5-5 in FIG. 4. FIG. 4 depicts a front or face view of antenna 400, as it might appear when deployed in a handheld RFID reader. Antenna includes a conductive loop element 402, which is preferably mounted or affixed to an appropriate substrate 404. Conductive loop element 402 is formed from an electrically conductive material such as, without limitation, copper, aluminum, gold, alloys thereof, or the like. In practice, conductive loop element 402 can be formed from a relatively thin sheet or printed film of metal, such as copper. Substrate 404 is preferably formed from a dielectric or insulating material such as, without limitation, plastic, an FR-4 circuit board, a ceramic material, a flexible vinyl material, or the like. In some embodiments, substrate 404 is a distinct component of an antenna module or package, as depicted in FIG. 1. In other embodiments, substrate 404 is an integrated part of a housing, shell, or other part of the RFID reader itself. For example, conductive loop element 402 may be printed on or attached to the inside wall of the overall housing of the RFID reader.

Conductive loop element 402 corresponds to the overall conductive trace or pattern of antenna 400. In FIG. 4, conductive loop element 402 is generally oval shaped. However, an embodiment of antenna 400 may employ a conductive loop element having alternative shapes, e.g., circular (see FIG. 6), triangular, square, oblong, barbell, elliptical, etc. Conductive loop element 402 includes a first end 406 and a second end 408, and the length of conductive loop element 402 is generally defined as the length of its major longitudinal path between first end 406 and second end 408. For the embodiment depicted in FIG. 4, the major longitudinal path of conductive loop element 402 corresponds to approximately one "lap" around the oval shaped route.

Antenna 400 has a first loop signal node 410 located at or proximate to first end 406, and a second loop signal node 412 located at or proximate to second end 408. First loop signal node 410 and second loop signal node 412 represent the RF input/output nodes for conductive loop element 402. In other words, first loop signal node 410 and second loop signal node 412 are used to apply an appropriate RF drive signal to conductive loop element 402, and to provide return signals from conductive loop element 402. In practice, a suitably configured RF transmission line (e.g., a two-conductor coaxial cable) can be coupled to first loop signal node 410 and second loop signal node 412 to accommodate the propagation of RF energy to and from conductive loop element 402. For such an embodiment, one conductor of the RF transmission line would be coupled to first loop signal node 410, and the other conductor would be coupled to second loop signal node 412.

Conductive loop element 402 is suitably sized, shaped, and configured to resonate at the desired frequency or frequency band with a first polarization. For the illustrated embodiment, conductive loop element 402 is horizontally polarized relative to the orientation and perspective of FIG. 4. Horizontal polarization is established because the loop signal nodes 410/412 of conductive loop element 402 are located at the top. On the other hand, if antenna 400 were instead oriented sideways (i.e., rotated ninety degrees relative to that depicted in FIG. 4), then conductive loop element 402 would be vertically polarized.

Conductive loop element 402 is tuned primarily by adjusting or selecting its length, i.e., the length of its major longitudinal path. A longer path results in a lower resonant frequency, and a shorter path results in a higher resonant frequency. Generally, the electrical length of conductive loop element 402 (which may be different than its physical length) should be approximately one wavelength long, referring to the desired operating frequency. Accordingly, the path length can be chosen to accommodate the particular frequency or frequency band of interest for the given RFID system. For one practical embodiment, one wavelength corresponds to an electrical loop length of about thirteen inches, however, the physical length of conductive loop element 402 can be reduced to about four to six inches using electronic circuits, networks, and/or components (e.g., inductive and capacitive loads, baluns, etc.). As one non-limiting example, the height 414 of conductive loop element 402 may be within the range of about 0.5 inches to about 2.5 inches, and the width 416 of conductive loop element 402 may be within the range of about 2.0 inches to about 3.5 inches.

Antenna 400 also includes at least one slot 418 formed in conductive loop element 402. Slot 418 is defined by an area within conductive loop element 402 that lacks conductive material. Slot 418 creates a feature in conductive loop element 402 that operates independently of conductive loop element 402. Simply put, the loop antenna element and the slot antenna element are isolated from each other. Moreover, the impedance of conductive loop element 402 will be much lower than the impedance of slot 418, further enabling their coexistence. It is therefore not necessary to switch between the two antenna elements to make their respective feeds RF-invisible to each other.

In preferred embodiments, slot 418 is formed between first end 406 and second end 408 of conductive loop element 402, and slot 418 is generally oriented along, and is substantially in alignment with, the major longitudinal path of conductive loop element 402. In other words, slot 418 follows the shape, contour, and path of conductive loop element 402. Although not always required, slot 418 may be centered in the path of conductive loop element 402, i.e., slot is aligned with the central longitudinal axis of the path. Notably, because slot 418 follows the overall geometry of conductive loop element 402, isolation is preserved between slot 418 and conductive loop element 402. In other words, operation of slot 418 as an antenna element is unaffected by operation of conductive loop element 402 as an antenna element, and vice versa. Moreover, tuning of conductive loop element 402 is relatively independent of tuning of slot 418.

Slot 418 includes a first end 420 and a second end 422. In the illustrated embodiment, first end 420 of slot 418 is located at or proximate to first end 406 of conductive loop element, and second end 422 of slot 418 is located at or proximate to second end 408 of conductive loop element. In alternate embodiments, the ends of slot 418 need not be co-located with the ends of conductive loop element 402. In FIG. 4, slot 418 is balanced and symmetrically positioned within conductive loop element 402. Such balance and symmetry is not always required, and alternate embodiments may employ a slot configuration that is offset or skewed within the loop element. However, when the slot is symmetric in the loop, the radiated pattern will tend to be more symmetric as a result. For this type of antenna, the preferred embodiment would have the two radiation patterns significantly overlapping, allowing the user to read both vertical and horizontal tags in the same field of view without physically manipulating the reader. In addition to skewing the pattern, the polarization may be affected as the slot becomes asymmetric. Ideally, a symmetric slot inside the loop yields a slot polarization that is orthogonal to the loop polarization. A symmetric slot may also be easier to manufacture, and an antenna with a symmetric slot may be easier to assemble into the system.

Antenna 400 has a first slot signal node 424 and a second slot signal node 426, which are located on conductive loop element 402. The location of slot signal nodes 424/426 along the path of slot 418 can affect impedance matching of antenna 400 and, therefore, the particular location may be chosen according to the specifications and characteristics of the system. For the illustrated embodiment, both slot signal nodes 424/426 are located at or proximate to first end 420 of slot 418. Alternatively, slot signal nodes 424/426 may instead be located at or proximate to second end 422 of slot 418 without altering the performance of antenna 400. For this particular embodiment, slot signal nodes 424/426 are also located at or proximate to first end 406 of conductive loop element 402. Alternatively, slot signal nodes 424/426 may instead be located at or proximate to second end 408 of conductive loop element 402 without altering the performance of antenna 400.

Slot signal nodes 424/426 represent the RF input/output nodes for slot 418. In other words, slot signal nodes 424/426 are used to apply an appropriate RF drive signal to slot 418, and to provide return signals from slot 418. Accordingly, slot signal nodes 424/426 are located on opposite sides of slot 418. In other words, first slot signal node 424 resides at one side of slot 418, and second slot signal node 426 resides at the other side of slot 418, preferably opposite first slot signal node 424. In practice, a suitably configured RF transmission line (e.g., a two-conductor coaxial cable) can be coupled to first slot signal node 424 and second slot signal node 426 to accommodate the propagation of RF energy to and from slot 418. For such an embodiment, one conductor of the RF transmission line would be coupled to first slot signal node 424, and the other conductor would be coupled to second slot signal node 426.

Slot 418 is suitably sized, shaped, and configured to resonate at the desired frequency or frequency band with a second polarization, which is different than the first polarization of conductive loop element 402. For the illustrated embodiment, slot 418 is vertically polarized relative to the orientation and perspective of FIG. 4. On the other hand, if antenna 400 were instead oriented sideways (i.e., rotated ninety degrees relative to that depicted in FIG. 4), then slot 418 would be horizontally polarized. Notably, the hybrid/combined structure of antenna 400 allows it to operate in a polarization insensitive manner, where conductive loop element 402 is configured to operate as a first antenna polarized in a first orientation and where slot 418 is configured to operate as a second antenna polarized in a second orientation. In preferred embodiments, conductive loop element 402 and slot 418 are orthogonally polarized relative to each other, and they operate as orthogonally polarized antennas.

Notably, slot 418 is tuned such that it resonates at or near the same frequency or frequency band as conductive loop element 402. Slot 418 is tuned primarily by adjusting or selecting its length (i.e., the length along the major longitudinal path of conductive loop element 402) and its gap width 428. A longer path results in a lower resonant frequency, and a shorter path results in a higher resonant frequency. The gap width 428 of slot 418 tunes the bandwidth of slot 418: a wider gap generally results in more bandwidth, while a narrower gap generally results in less bandwidth. Thus, the length and gap width 428 of slot 418 can be chosen to accommodate the particular frequency or frequency band of interest for the given RFID system. As one non-limiting example, slot 418 may be within the range of about 4.0 to 6.5 inches long and the gap width 428 of slot 418 may be within the range of about 0.025 to 0.150 inches.

Alternate embodiments of an RF antenna as described herein can utilize more than one slot formed in a conductive loop element. Multiple slots may be used to broaden the frequency response of the antenna. In such alternate embodiments, additional slot signal nodes may also be employed (as needed) to accommodate additional RF transmission lines.

Figure 6:
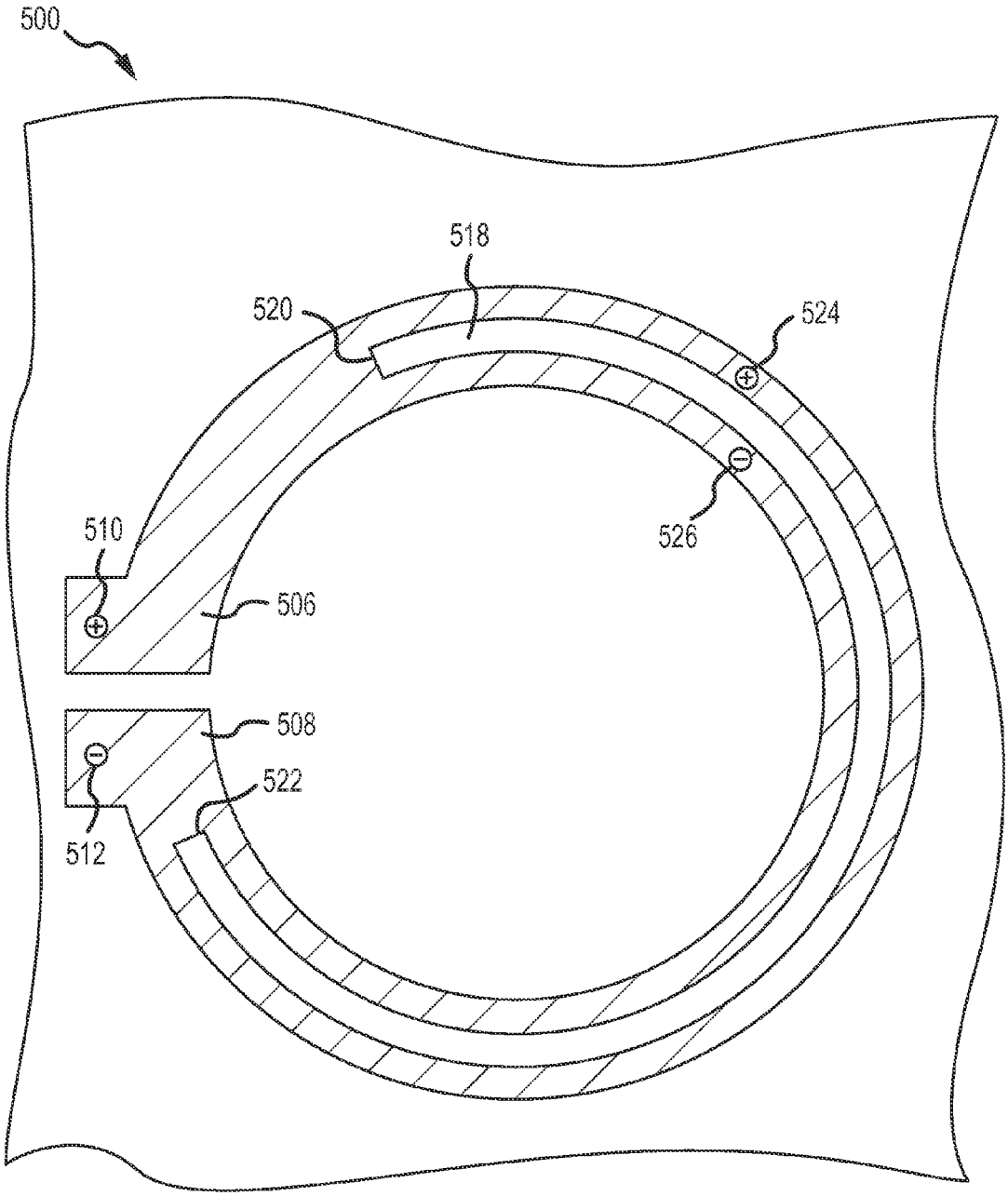
FIG. 6 is a layout diagram of a second embodiment of an RF antenna suitable for use in an RFID reader.

FIG. 6 is a layout diagram of a second embodiment of an RF antenna 500 suitable for use in an RFID reader. Antenna 500 has several different features and characteristics, compared to antenna 400. For example, antenna 500 utilizes a circular conductive loop element 502 rather than one having an oval shape. Moreover, conductive loop element 502 is vertically polarized relative to the orientation and perspective of FIG. 5, because the loop signal nodes 510/512 of conductive loop element 502 are located at the side. On the other hand, if antenna 500 were rotated ninety degrees relative to that depicted in FIG. 6, then conductive loop element 502 would be horizontally polarized.

The slot 518 formed within conductive loop element 502 is not symmetric or balanced. In other words, one end 520 of slot 518 is relatively distant from the first end 506 of conductive loop element 502, while the other end 522 of slot 518 is relatively close to the second end 508 of conductive loop element 502. FIG. 6 depicts how slot 518 is skewed or offset within conductive loop element 502.

As described above for antenna 400, the slot signal nodes need not be positioned proximate an end of the slot (although end positioning usually results in better performance). In this regard, FIG. 6 depicts an embodiment where the slot signal nodes 524/526 are located relatively far away from the ends 520/522 of slot 518. Moreover, slot signal nodes 524/526 need not be directly opposite each other—FIG. 6 depicts such an embodiment.

Exemplary operating modes of RFID reader 300 and antenna 400 will now be described with reference to FIG. 3 and FIG. 4. Processor 308 may be suitably configured to control the operation of RFID reader 300 (and, in particular, RF communication module 302) in accordance with a number of different operating modes. For example, RF communication module 302 may be suitably controlled and configured to drive conductive loop element 402 and to not drive slot 418 during a first operating mode (e.g., horizontal polarization mode). Conversely, RF communication module 302 may be suitably controlled and configured to drive slot 418 and to not drive conductive loop element 402 during a second operating mode (e.g., vertical polarization mode).

In certain embodiments, RF communication module 302 can switch between operating modes to alternately drive conductive loop element 402 with a first drive signal, and drive slot 418 with a second drive signal (the first and second drive signals in this example may be the same or different). This switching mode may be desirable to maintain full transmit power for both polarizations in an alternating manner. The switching frequency may be selected to suit the needs of the particular application. In addition, one polarization mode can be weighted more than the other if desired. Such weighting may be beneficial in environments where the number of horizontally polarized RFID tags is greater than the number of vertically polarized RFID tags (or vice versa).

Alternatively (or additionally), RFID reader 300 may be suitably configured to simultaneously drive conductive loop element 402 and slot 418 using the same drive signal or different drive signals. This is possible because at any instant of time one end of conductive loop element 402 is positive and the other end is negative, while one side of slot 418 is positive and the other side is negative. As mentioned above, conductive loop element 402 and slot 418 are preferably tuned to resonate at the same frequency or frequencies and, therefore, RF communication module 302 can drive both of the orthogonally polarized antenna elements with a common RF drive signal. In practice, this allows RFID reader 300 to interrogate a group of RFID tags that may not be polarized or oriented in the same manner.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. An antenna for a radio frequency identification (RFID) reader, the antenna comprising:

a conductive loop element configured to resonate substantially with a first polarization, the conductive loop element defining a major longitudinal path corresponding to a route around an interior area of an insulating substrate on which the conductive loop element is mounted; and a slot formed in the conductive loop element, the slot being configured to resonate substantially with a second polarization.

2. The antenna of claim 1, wherein the first polarization and the second polarization are substantially orthogonal.

3. The antenna of claim 1, wherein:

the conductive loop element comprises a first end and a second end in close proximity to each other such that the conductive loop element almost completely encloses the interior area of the insulating substrate; and the antenna further comprises a first loop signal node at the first end, and a second loop signal node at the second end.

4. The antenna of claim 1, wherein:

the conductive loop element comprises a first end and a second end in close proximity to each other such that the conductive loop element almost completely encloses the interior area of the insulating substrate; and the slot is formed in the conductive loop element between the first end and the second end.

5. The antenna of claim 1, further comprising:

a first slot signal node at a first side of the slot; and a second slot signal node at a second side of the slot.

6. The antenna of claim 1, wherein:

the slot is oriented along the major longitudinal path.

7. The antenna of claim 1, further comprising:

a first loop signal node located proximate a first end of the conductive loop element;

a second loop signal node located proximate a second end of the conductive loop element;

a first slot signal node located on the conductive loop element proximate an end of the slot; and a second slot signal node located on the conductive loop element proximate the end of the slot; wherein the first slot signal node and the second slot signal node are located on opposite sides of the slot.

8. The antenna of claim 7, wherein the first slot signal node and the second slot signal node are located proximate either the first end or the second end of the conductive loop element.

9. A handheld radio frequency identification (RFID) reader comprising:

a radio frequency (RF) communication module configured to process RF signals associated with operation of the RFID reader; and a polarization insensitive antenna coupled to the RF communication module, and configured to transmit and receive RF energy associated with operation of the RFID reader, the antenna comprising:

an insulating substrate;

a conductive loop element mounted to the insulating substrate, the conductive loop element having a major longitudinal path forming a loop around an interior area of the insulating substrate, the conductive loop element being configured to operate as a first antenna polarized in a first orientation; and a slot formed in the conductive loop element along the major longitudinal path, the slot being configured to operate as a second antenna polarized in a second orientation.

10. The handheld RFID reader of claim 9, wherein the conductive loop element and the slot are configured to operate as substantially orthogonally polarized antennas.

11. The handheld RFID reader of claim 9, wherein the RF communication module is configured to drive the conductive loop element and the slot with a common RF drive signal.

12. The handheld RFID reader of claim 11, further comprising:

a first RF transmission line for the conductive loop element, the first RF transmission line being coupled between the RF communication module and the conductive loop element; and a second RF transmission line for the slot, the second RF transmission line being coupled between the RF communication module and the slot.

13. The handheld RFID reader of claim 9, wherein the RF communication module is configured to alternately drive the conductive loop element and the slot.

14. The handheld RFID reader of claim 9, wherein:

the RF communication module is configured to drive the conductive loop element and not drive the slot during a first operating mode; and the RF communication module is configured to drive the slot and not drive the conductive loop element during a second operating mode.

15. An antenna arrangement for a radio frequency identification (RFID) reader, the antenna arrangement comprising:

a conductive loop element having a first end, a second end, and a major longitudinal path defined between the first end and the second end, the first and second ends in close proximity to each other such that the conductive loop element substantially surrounds an interior area of an insulating substrate on which the conductive loop element is mounted;

a slot formed in the conductive loop element and in alignment with the major longitudinal path;

a first radio frequency (RF) transmission line having a first conductor coupled proximate to the first end of the conductive loop element, and a second conductor coupled proximate to the second end of the conductive loop element; and a second RF transmission line having a third conductor coupled to the conductive loop element, and a fourth conductor coupled to the conductive loop element, the third conductor and the fourth conductor being coupled to the conductive loop element at opposite sides of the slot; wherein a first drive signal propagated along the first RF transmission line drives the conductive loop element as a loop antenna having a first polarization; and a second drive signal propagated along the second RF transmission line drives the slot as a slot antenna having a second polarization.

16. The antenna arrangement of claim 15, wherein the first polarization and the second polarization are substantially orthogonal to each other.

17. The antenna arrangement of claim 15, wherein the third conductor and the fourth conductor are coupled to the conductive loop element proximate to either the first end or the second end of the conductive loop element.

18. The antenna arrangement of claim 15, further comprising an RF communication module coupled to the first RF transmission line and the second RF transmission line, the RF communication module being configured to generate the first drive signal and the second drive signal.

19. The antenna arrangement of claim 18, wherein the RF communication module is configured to alternately drive the conductive loop element with the first drive signal and the slot with the second drive signal.

20. The antenna arrangement of claim 18, wherein:

the RF communication module is configured to simultaneously drive the conductive loop element with the first drive signal and the slot with the second drive signal; and the first drive signal and the second drive signal are identical.

* * * * *